United States Patent [19]

Simpson et al.

[11] Patent Number: 4,793,023

[45] Date of Patent: Dec. 27, 1988

[54] DOOR CLOSER AND HOLDER

[75] Inventors: Jeffery M. Simpson, Monroe; Clay E. Tully, Charlotte, both of N.C.

[73] Assignee: Yale Security Inc., Monroe, N.C.

[21] Appl. No.: 61,785

[22] Filed: Jun. 15, 1987

[51] Int. Cl.[4] ..... E05F 3/22

[52] U.S. Cl. ..... 16/58; 16/62; 16/52

[58] Field of Search ..... 16/49, 51, 52, 56, 58, 16/62, 66

[56] References Cited

U.S. PATENT DOCUMENTS

| | | | |
|---|---|---|---|
| 4,050,114 | 9/1977 | Zunkel | 16/51 X |
| 4,267,619 | 5/1981 | Suska | 16/52 X |
| 4,349,939 | 9/1982 | Tillman | 16/58 X |
| 4,378,612 | 4/1983 | Beers | 16/62 |
| 4,414,703 | 11/1983 | Schnarr et al. | 16/52 |

FOREIGN PATENT DOCUMENTS 889154 2/1962 United Kingdom .

*Primary Examiner*—Nicholas P. Godici
*Assistant Examiner*—Carmine Cuda
*Attorney, Agent, or Firm*—Dallett Hoopes

[57] ABSTRACT

A door closer and holder comprises a cylinder shell having a piston sealingly reciprocable therein. A spring biases the piston toward one end of the shell, and the piston is connected through the ususal apparatus to the door. At the one end the operating rod of a shuttle valve extends into the shell and is engaged by the piston as it approaches the end. The shuttle valve selectively directs the return fluid flow through sweep- and latch-control valves. The assembly also includes a solenoid-operated "bullet" which closes off the return flow to hold the door open. The angle of the openness at which the door is held may be selected by setting a cam on the holder drive pinion which engages a switch to activate the solenoid.

7 Claims, 3 Drawing Sheets

DOOR CLOSER AND HOLDER

BACKGROUND OF THE INVENTION

1. Field of the Invention

This invention relates to mechanical door closers and holders. More specifically, this invention relates to a door closer and holder possessing an unusual ability to hold the door at a given degree of openness for a long period of time.

2. Discussion of the Prior Art

The prior art includes a number of patents which disclose door closers of the piston type wherein the piston is disposed in a chamber add is formed with a rack in an intermediate position thereof, driving a pinion attached to the closer arm. A spring urges the piston in a direction towards the closed position of the door.

An example of such a closer is found in the U.S. Pat. No. 4,378,612 which issued Apr. 5 1983 to Bruce N Beers. In this patent passageways are disposed in the wall of the closer and are occasionally obscured or opened by a portion of the piston as it moves in closing the door. The passageways are arranged so that, depending on the position of the piston, the fluid within the closer moves from one side of the piston to the other at the desired speed, the flow around the portion of the piston being determined by "sweep and latch" valves disposed in the passages.

One of the drawbacks of such prior structures is that with sweep and latch valve passageways extending directly into the wall of the piston chamber, it is not possible to have a good seal between the piston and the chamber itself. This is because if packing or other sealing means is disposed around the piston it engages the sharp edges defining the passage openings and may be actually sheared off from the rest of the packing and extruded through the control passages themselves. Because of such damage to packing by the openings in the wall of the piston chamber, packing has been dispensed with and the piston has been operated in the chamber without a seal, and there has been a gradual creeping of the piston toward the closed position as the oil moves along the periphery of it.

In the prior art there is a showing in a closer of using the pinion shaft of a closer to drive a cam linked to a switch for spreading flow in the closer at the latch end of the cycle. This showing, U.S. Pat. No. 4,267,619, issued May 19, 1981 to Suska, does not teach using such an arrangement to control hold open.

SUMMARY OF THE INVENTION

The present invention makes possible the provision of a U seal, an O ring, or other resilient sealing means on a piston in a door closer of the same general type as discussed above. This is made possible by having a separate piston-actuated plunger in its own separate chamber in a manifold on the end of the closer housing. The plunger chamber is formed with openings for sweep and latch flow controls, and the plunger moves by these openings being moved by the piston as it approaches closing position of the door. In addition, the flow of fluid from one side of the piston in the main chamber to the other is through a "bullet" chamber, which houses a cylindrical bullet which may be pressed against the flow orifice by a solenoid-actuated rod to stop the flow of oil. The pressure of the solenoid against the bullet may be overwhelmed by forcibly commencing the door on its closing travel and increasing the pressure of oil through the orifice. A conventional check valve is installed in the piston to permit oil to pass through the piston when the door is opening.

The invention further includes the provision of a switch in circuit with the solenoid, the switch being positioned on the outside of the closer adjacent the pinion shaft and adapted to be actuated by a settable cam finger on the shaft. Thus, the setting of the cam finger controls the position of the door at which the solenoid holds the bullet against the aforementioned orifice and therefore the hold-open angle of the door.

BRIEF DESCRIPTION OF THE DRAWINGS

Other features and objects of the invention will be apparent from the following specification and the attached drawings all of which present a non-limiting form of the invention. In the drawings.

DESCRIPTION OF THE EMBODIMENT

Figure 3:
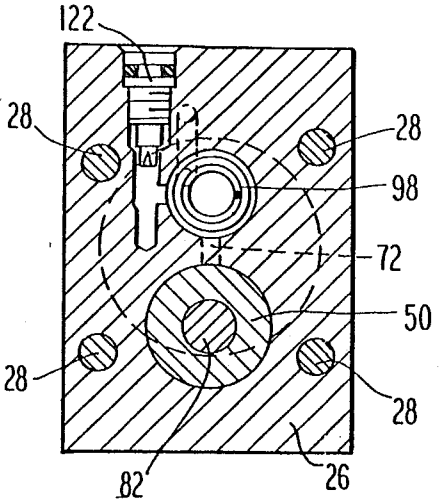
FIG. 3 is a sectional view taken on the line 3—3 of FIG. 1.
Figure 4:
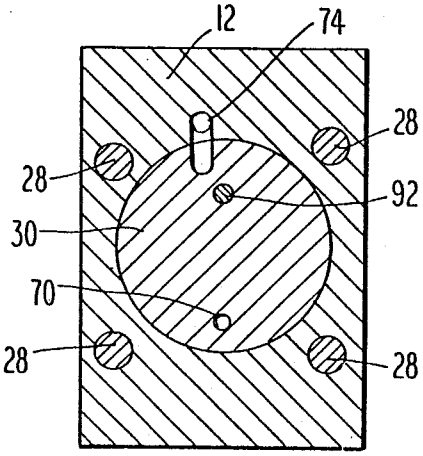
FIG. 4 is a sectional view taken on the line 4—4 of FIG. 2.
Figure 1:
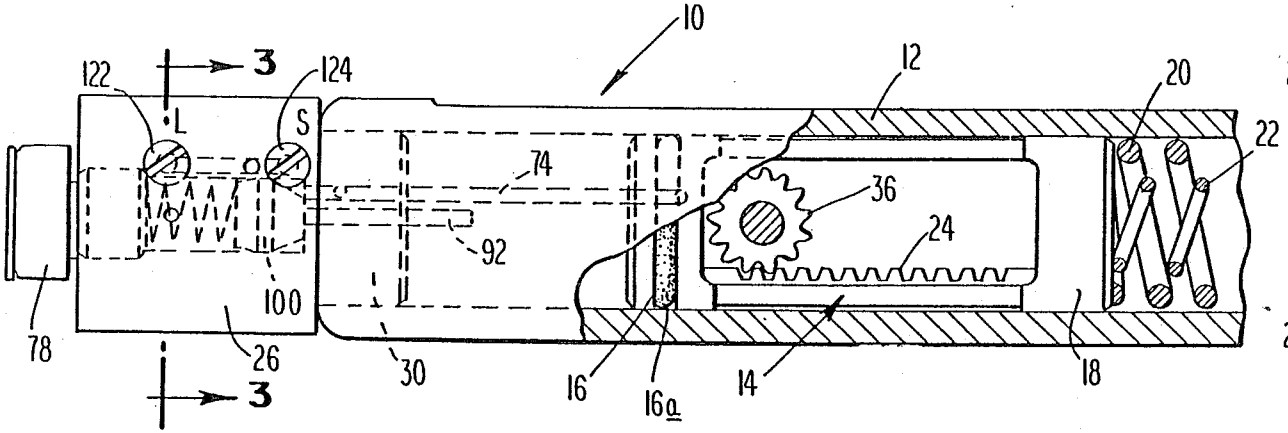
FIG. 1 is a top plan fragmentary view of a closer embodying the invention and shown partly in section.
Figure 2:
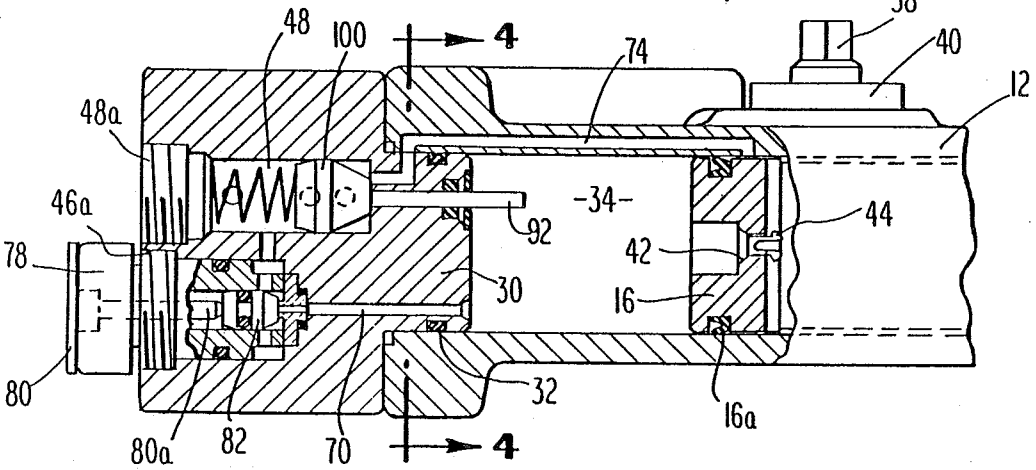
FIG. 2 is a fragmentary side elevation, also shown partly in section.

A door closer embodying the invention is shown in FIG. 1 and generally designated 10. It comprises a cylindrical oil-filled housing 12 having a piston 14 operatively moving therein. The piston is formed with a peripheral groove 16 about its leftward end in which is disposed a U seal **16*a* the said leftward end and seal comprising a journal. The opposite end 18 of the piston is also cylindrical and is urged forward by a combination of springs 20, 22 in compression between the piston and the right end wall of the housing 12, as is conventional. Intermediate the ends of the piston 14 is a reduced area formed with a rack 24. A manifold 26 is mounted by bolts 28 (FIG. 3) on the end of the cylinder housing 12. It includes a cylindrical projection on 30 which extends into the housing, and carries a sealing ring 32 which prevents leakage out of the chamber 34. Chamber 34** comprises the pressure chamber for hydraulic fluid as the door is closing.

Meshing with rack 24 is the pinion 36, which is on a shaft 38 journaled in bearings 40 in the upper and lower portion of the cylinder 12. As is conventional, an end of the arm of the door (not shown) is mounted on the shaft 38.

As is also conventional, the end 16 of the piston has a passage 42 with a beveled seat, and a plastic check valve 44 moves longitudinally in the passage, closing off the passage with its enlarged head during the closing of the door to prevent oil from passing through the piston.

Figure 5:
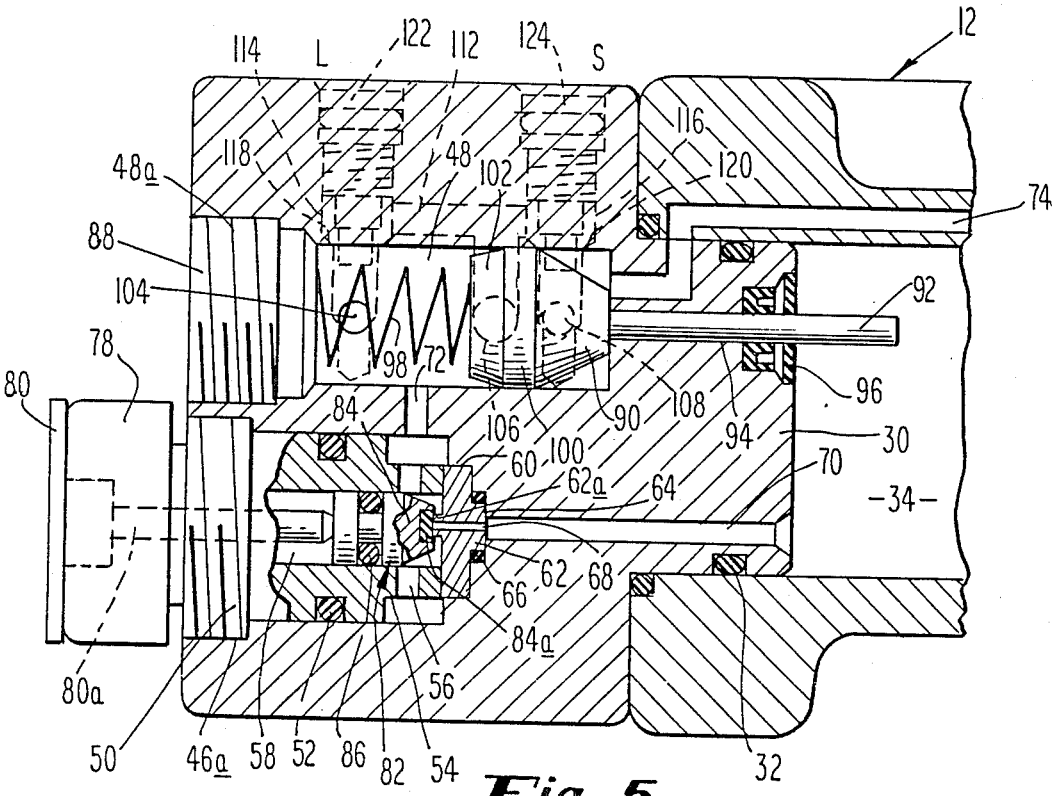
FIG. 5 is an enlarged fragmentary sectional view showing the manifold.

While the oil with which the closer is filled moves readily through the passage 42 in the piston 16 during the opening of the door, during the closing because the check valve 44 is seated, movement of the piston 14 leftwardly as urged by the springs 20, 22 is impeded and controlled by the return flow of oil through formed inward from the outward end of the manifold 26. The first recess may be called the "bullet" recess, while the second recess 48 may be termed the "plunger" recess. Both recesses have threaded openings 46*a* and 48*a* respectively (FIG. 5).

Figure 6:
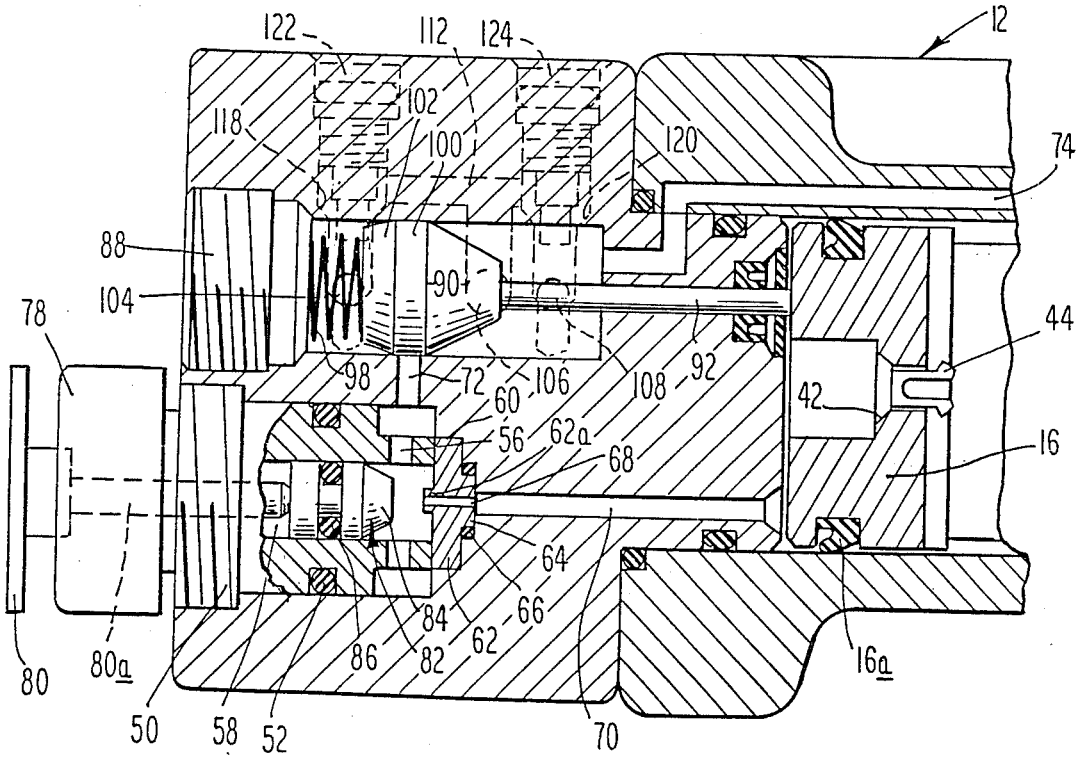
FIG. 6 is a sectional view similar to FIG. 5 but showing the "bullet" in unseated position.

The bullet recess receives a threaded fitting 50, which is reduced to conform to the sidewalls of recess and provided with an O ring 52. The fitting is reduced at its inner end 54 and formed with a pair of lateral openings 56 into a central axial bore 58. The bullet recess is formed itself with a reduced inner end 60 into which fits an orifice plate 62 having a boss 64 centrally disposed in it. The boss is surrounded by an O ring 66 which engages the stepped wall 60. Plate 62 is formed with a central orifice 68, which is a fixed diameter and, in practice, may be in the range of 0.047 to 0.062 inches in diameter for restricting the flow of oil through the return system. On the left-hand side of the orifice plate 62 (FIGS. 5 and 6) is the lip 62*a* extending longitudinally and providing a seat for the right-hand end of the bullet 82 to be described. The general structure of the bullet and its chamber is as described in the U.S. Pat. No. 4,414,703, which issued Nov. 15, 1983 to Schnarr et al.

The return system comprises an inlet passage 70 from the chamber 34 which communicates to the end of the orifice plate and is axially aligned with orifice 68 into the bullet recess. It also comprises the passage 72 communicating between the bullet recess and the plunger recess 48. The plunger recess 48 is formed with a drain or downstream passage 74 which communicates with the inner end of recess 48, jogs perpendicularly in a dogleg, and then extends in the wall of the cylinder 12 to a point in the inside of the cylinder 12 rightward of the seal 16*a* on the piston 14 when the piston is in its most rightward position.

Mounted on the outer end of the threaded fitting 50 is the solenoid 78, which includes the armature plate 80 having a stem 80*a* extending into the bore 58. A bullet 82 is disposed in the passage 58 and comprises a cylindrical body having a tapered nose 84 formed with a flattened end having a rubber insert 84*a* (FIG. 5) which closes over the orifice lip or seat 62*a* when the bullet is rightward in bore 58. The bullet is formed with a peripheral groove in which is disposed an O ring 86.

A plug 88 is threaded into the plunger bore 48 and is formed with a circular recess in its inner end (not shown). Disposed normally at the opposite end of the plunger bore is the plunger 90, which is provided with an integral stem 92 extending through an opening 94 in the manifold and on into the chamber 34. Seals 96 are provided about the stem 92 to prevent leakage through passage 94. The plunger 90 has in its leftward end a recess similar to the recess in the inner end of plug 88 described above. Between these two recesses is disposed a compression spring 98 which urges the plunger rightwardly in the chamber 48. The plunger is formed with a central band 100 which touches the wall of chamber 48 in non-sealing relation. From band 100 the plunger side is inclined in a chamfered or tapered section 102, chamfered preferably at a slight angle such as four to ten degrees away from the adjacent wall of chamber 48. The band 100 controls the flow of fluid through the latch and sweep passageways as will be described.

Disposed in the wall of the chamber 48 are three aligned openings 104, 106 and 108. Preferably, opening 106 is larger than openings 104 or 108, and from opening 106 extends a passage up to a horizontal passage 112 communicating on its opposite ends with the latch valve chamber 114, marked "L" (FIGS. 1 and 5), and the sweep valve chamber 116, marked "S," as shown below the juncture with the passage 112. The latch valve chamber 114 is formed with an inclined shoulder 118, and similarly a shoulder 120 is formed in chamber 116 beneath its juncture with passage 112. Valve elements 122 and 124 are threadedly disposed respectively in chambers 114 and 116, and are shaped to cooperate respectively with the seats 118 and 120 in controlling the flow of fluid through the latch and sweep modes.

In operation, the door closer and holder described operates in the following manner. Assuming that the door is open in its hold-open position, the solenoid 78 is activated so that stem 80*a* presses the bullet 82 rightward to close off the end of the orifice 68. The presence of the U seal 16*a* on the piston prevents the piston from being urged leftward by the springs 20 and 22. Movement of the bullet off the orifice plate 62 can be accomplished by either of two scenarios.

First, as in the event of a sensor sensing the presence of smoke or fire, the solenoid 78 can be deactivated. Upon this happening the stem 80*a* will move leftwardly and the bullet 82 will be urged off the seat 62*a* by the pressure of the oil through the orifice 68. The bullet and stem will thereupon be in the relative positions with respect to the orifice 68 shown in FIG. 6. The fluid will then flow through the passage 72 into the plunger chamber 48 as will be described.

The second scenario under which the bullet is moved off the orifice seat 68 is by some person manually urging the door towards the closed position from the hold-open position. This will build up pressure through passage 70 and into orifice 68 to the extent that the bullet 82 will be "popped off" seat 62*a* and will be propelled leftwardly overwhelming the solenoid 78, whereupon the stem 80*a* and the bullet 82 will be in the position shown in FIG. 6, and despite the solenoid being engaged the movement of the door after the initial push will keep the oil moving through the orifice 68. The solenoid is not sufficiently strong to move the bullet back to. closed position once the flow is started.

In either event described above, the door will commence closing and the piston 14 will start to move leftwardly as oil passes and 112 into the sweep valve chamber 116. From there the oil will move past the sweep seat 120 to the extent that the setting of valve 124 will permit it and will emerge out the opening 108 into the chamber 48 and through passage 74 to the right-hand side of the sealed piston 16.

As the movement of the piston 14 continues, head 16 will eventually engage the end of rod 92 and will move the plunger so that for an instant the closing wall-touching band 100 aligns with opening 106. Preferably opening 106 is sufficiently wide as to not be totally occluded by band 100, and flow as described through the valve chamber 116 will continue. Further in its passage the plunger band 100 will move leftward altogether of the opening 106, and the control flow out of chamber 48 will be through passage 104, past the latch seat 118 to the extent that the setting of the latching valve 122 will permit it, through passages 112 and 102 and opening 106. The flow will continue on through drain passage 74 and back into the cylinder behind the piston.

The result of this structure and movement will be that for the first portion of the door closer the speed of the door will be controlled by sweep valve 124. Adjacent latching, however, where the piston head 16 is engaging rod 92 and depressing it so that the plunger band 100 is to the left of opening 106, latch valve 122 will control latching speed.

The plunger is thus, in effect, a shuttle valve alternately connecting the metering valves "S" and "L" in the oil return line as the door closes.

It may be that the latch speed will be selected as relatively fast compared to a slow sweep speed so that the door in closing will not bang against a patient or object and yet good latching will be assured. On the other hand, the sweep could be fast as in the event of a fire and the latching be relatively slow and quiet. The present arrangement is adaptable to either alternative.

It should be clear that there are other features of door closers embodying the invention which have nothing to do with the invention itself. For instance, on the rightward side of the plunger there may be provided the customary opening control valves which restrict the flow of fluid from the spring chamber to the chamber intermediate the ends of the piston. Such an arrangement is disclosed in U.S. Pat. No. 4,050,114, which issued Sept. 27, 1977, and is now assigned to our assignee.

It will be clear that the present invention makes possible the firm holding open of the door at the desired position in a way which will be maintained indefinitely. This is due to the provision of the seal 16*a* on the piston head 16. As stated, use of such a seal in the past wherein speed-control openings were provided in the piston chamber was not practicable due to the chewing up of such a seal by the openings. The present invention eliminates the problem by relocating the openings into an auxiliary plunger chamber 48, which features the plunger 90, the stem 92 of which is operated on by the piston head.

Figure 7:
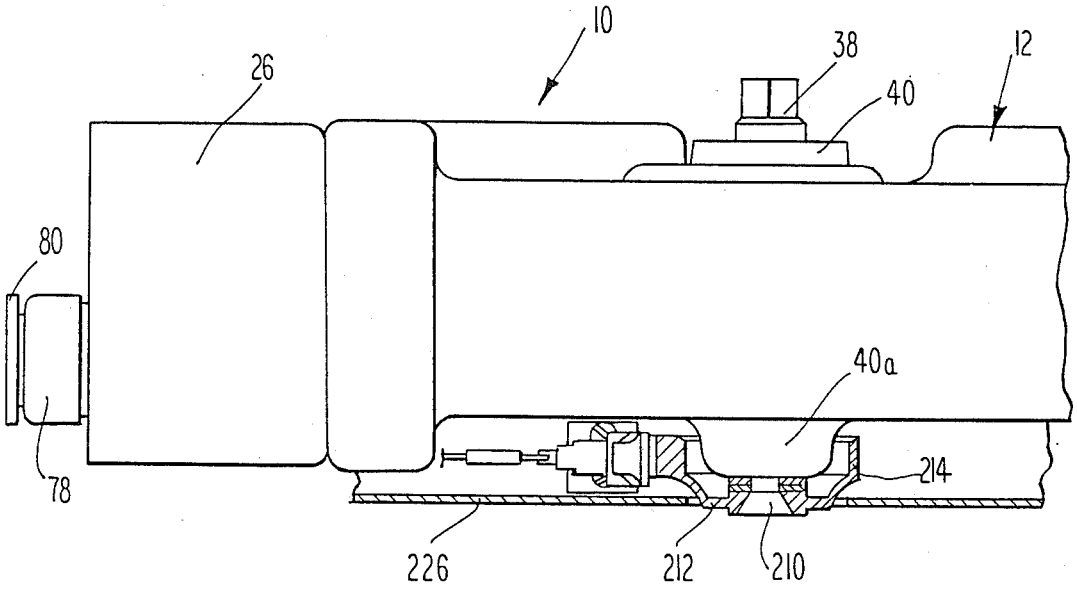
FIG. 7 is an enlarged fragmentary front elevational view, partly in section, of an embodiment including a settable hold-open position switch.
Figure 8:
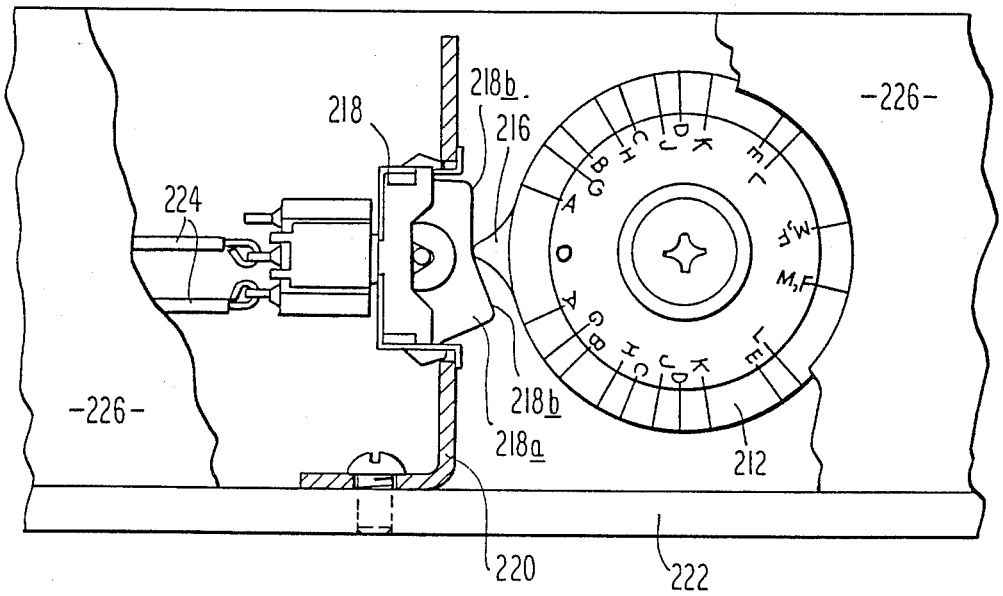
FIG. 8 is a further enlarged fragmentary bottom plan view, also partly in section, of the embodiment of FIG. 7.

FIGS. 7 and 8 relate to an embodiment in which it is possible to set the open position of the door at which the bullet 82 closes the opening 68 and the closer holds the door. The embodiment includes, aside from the elements discussed hereabove and indicated by the same reference numerals, the lower shaft bearing 40*a* which surrounds the lower end of the shaft 38. The shaft has a central upward tapped hole receiving the flatheaded bolt 210 which mounts for rotation with the shaft, the molded cam 212.

Cam 212 is formed with an upward peripheral skirt 214 which is parallel to the shaft. Formed in the skirt 214 is a finger 216 which protrudes perpendicularly outward. A rocker-type switch 218 having the actuator 218*a* with the customary angled faces 218*b* is mounted on bracket 220 anchored to the back plate 222 in turn secured to the wall or closer track. Leads 224 from the switch are in series with the solenoid 78 and control its activation.

The lower face of the cam 212 carries indicia so that the cover 226 can be removed, the door closed, the bolt 210 loosened and the cam set. The setting of the cam involves rotating it with respect to its shaft so that a selected indicia on the cam is opposite the center line of the switch, that is, the point where surfaces 218*b* converge. Bolt 210 is then tightened. The indicia, incidentally, are at angular points on the cam corresponding to angle of desired hold-open of the door depending, of course, on whether the arm of the closer is a double arm or a slide arm. The cover 226 is also secured to the housing 12.

Operation of the embodiment, including the settable cam described above, is basically the same as the operation without the settable cam. In addition, however, the provision of th settable cam makes it possible to set the angle of openness of the door at which the solenoid is engaged. More specifically, when the door is opened, the pinion shaft 38 rotates the cam 212 so that when the desired degree of openness is past, the finger 216 moves by the rocker switch actuator 218*a* to flip it, energizing the solenoid 78. This drives the shaft 80*a* inward, pressing the bullet 82 against seat 62*a*, closing off the flow of oil on its return, thereby holding the door open by at least the preset angle of openness.

Subsequently, when the door is forcebly closed, the bullet 82 is driven open, overpowering the force of the solenoid 78 and causing the actuator 218*a* of the rocker switch to flip as finger 216 passes. This, of course, deenergizes the solenoid until the next opening of the door beyond the preset degree of openness whereat the switch 218 is again flipped to activate the solenoid.

It should be clear that also in circuit with the switch 218 can be the conventional smoke detector which, upon sensing the presence of smoke, can open its own switch to deactivate solenoid 78 and override switch 218.

Indicia on one half of the cam 212 mirrors the other half to permit changes in hand of the door.

It should be clear that rearrangement of the parts of the structure will be possible, and the extent of coverage sought should not be limited by the specification embodiment disclosed. The invention is defined by the following claim language and equivalents.

We claim:

1. A door closer and holder comprising:

a. an assembly including an oil-filled closed cylinder shell having therewithin a reciprocable journal in sealing engagement with the wall thereof;

b. a control manifold at one end of the shell, the manifold being formed with a plunger chamber, the chamber being generally cylindrical, c. a plunger in the plunger chamber and having a shaft extending through a sealed bore in the manifold and into the interior of the shell to be engaged and depressed by the journal near the end of its travel toward the manifold end, d. biasing means urging the plunger toward the shell, e. in the manifold and shell, (1) inlet passage means interconnecting the manifold end of the shell and the plunger chamber at an opening in the chamber on the opposite side of the plunger from the shell, (2) drain passage means interconnecting the end of the plunger chamber more adjacent the shell and an opening in the shell on the opposite side of the journal from the manifold, (3) latch passage means interconnecting longitudinally spaced first and second openings in the wall of the plunger chamber, the first opening being more remote from the shell than the second opening, both openings being outward of the plunger when the plunger is in a first position close to the shell, and on opposite sides of the plunger when the plunger is moved by the journal to a second position away from the shell, (4) sweep passage means interconnecting the second opening and a third opening in plunger chamber at a point on the opposite side of the plunger from the other two openings when the plunger is in the first position, f. spring means urging the journal toward the manifold, g. check valve means in a return passageway in the assembly, the passageway communicating between oil on opposite sides of the journal, the check valve means adapted to open during movement of the journal away from the manifold end and close during movement of the journal toward the manifold end, and h. rack and pinion and operator arm means associated with the journal to convert the motion of the journal into motion-controlling means for the door.

2. A door closer and holder as claimed in claim 1 including a latch speed control valve in the latch passage means and a sweep speed control valve in the sweep passage means.

3. A door closer and holder as claimed in claim 1 wherein the plunger has at its end more remote from the shell a tapered end diverging away from the wall of the plunger chamber and partly occluding the second opening when the plunger is in the first position.

4. A door closer and holder as claimed in claim 1 including a bullet chamber in the manifold in side-by-side relation with the plunger chamber, the bullet chamber being disposed in the inlet passage means, and a solenoid adapted to drive the bullet to close the inlet passage to hold the door open.

5. A door closer and holder as claimed in claim 4 wherein the solenoid is insufficiently strong to move the bullet to close the port when the door is closing, but can so move the bullet when the door is not closing.

6. A door closer including an oil-filled housing having a piston circumposed by resilient sealing means sealingly engaging the wall of the housing, means linking the movement of the piston and the door, spring means in the cylinder urging the piston toward one end of the cylinder to close the door, first passage means connecting the said one end of the cylinder with a point in the housing on the other side of the piston from said end, a pair of separately settable metering valves alternately connectable in the passage means, and shuttle valve means alternately connecting the settable metering valves in the first passage means, the shuttle valve means having an actuator extending into the housing and engaged by and depressed by the piston as it approaches the said end of the cylinder, and second passage means. connecting the oil on the opposite sides of the piston sealing means and including check valve means adapted to close as the piston moves toward the said end and open when it moves in the reverse direction.

7. A door closer as claimed in claim 6 wherein the shuttle valve means comprises a plunger operating in a chamber, the first passage means being connected to the opposite ends of the chamber to flow through the chamber and three openings are longitudinally spaced along the side wall of the chamber, the center opening connected to each of the metering valves, the metering valves also being connected respectively to the other two openings, whereby the plunger as it moves in the chamber selects which of the two valves controls the flow in the first passage means.

* * * * *

UNITED STATES PATENT AND TRADEMARK OFFICE

CERTIFICATE OF CORRECTION

PATENT NO. : 4,793,023

DATED : Dec. 27, 1988

INVENTOR(S) : Jeffery M. Simpson and Clay E. Tully

It is certified that error appears in the above-identified patent and that said Letters Patent is hereby corrected as shown below:

Column 3, line 4, after "through", insert --the manifold 26. Basically, two relatively large recesses are--

Column 4, line 51, after "passes", insert --into chamber 48 and escapes through the opening 106, passages 102--

Signed and Sealed this

First Day of October, 1991

*Attest:*

*Attesting Officer*

HARRY F. MANBECK, JR.

*Commissioner of Patents and Trademarks*